US009513601B2

(12) United States Patent
Karapatis et al.

(10) Patent No.: US 9,513,601 B2
(45) Date of Patent: Dec. 6, 2016

(54) TIMEPIECE BARREL WITH IMPROVED TRANSMISSION OF FORCE

(71) Applicant: Montres Breguet SA, L'Abbaye (CH)

(72) Inventors: Polychronis Nakis Karapatis, Premier (CH); Davide Sarchi, Renens (CH); Rene Piguet, La Sarraz (CH); Benoit Junod, Les Rousses (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/799,842

(22) Filed: Jul. 15, 2015

(65) Prior Publication Data

US 2016/0026152 A1 Jan. 28, 2016

(30) Foreign Application Priority Data

Jul. 22, 2014 (EP) ..... 14177987

(51) Int. Cl.

| | |
|---|---|
| ***G04B 1/14*** | (2006.01) |
| ***G04B 1/18*** | (2006.01) |
| ***G04B 1/16*** | (2006.01) |
| ***G04B 1/10*** | (2006.01) |

(52) U.S. Cl.

CPC ..... *G04B 1/16* (2013.01); *G04B 1/105* (2013.01); *G04B 1/18* (2013.01); *G04B 1/185* (2013.01)

(58) Field of Classification Search

CPC ..... G04B 1/10; G04B 1/105; G04B 1/14; G04B 1/16; G04B 1/18; G04B 1/185

See application file for complete search history.

(56) References Cited

U.S. PATENT DOCUMENTS

| | | | | |
|---|---|---|---|---|
| 1,495,348 A | | 5/1924 | Odom | |
| 1,720,289 A | | 7/1929 | Odom | |
| 2,617,248 A | * | 11/1952 | Brown | G04B 1/18 185/43 |
| 2,709,332 A | * | 5/1955 | Meyer | G04B 5/245 368/209 |
| 2,717,527 A | * | 9/1955 | Rapp | G04D 1/041 81/7.5 |
| 2,993,689 A | * | 7/1961 | Johansson | F16F 1/10 139/87 |
| 3,012,431 A | * | 12/1961 | Schmidt | G04D 7/02 73/1.09 |
| 3,018,097 A | * | 1/1962 | Johansson | F03G 1/00 185/45 |
| 3,599,422 A | * | 8/1971 | Haueter | G04B 1/185 368/147 |
| 2008/0225646 A1 | * | 9/2008 | Zaugg | G04B 9/00 368/66 |
| 2012/0044789 A1 | | 2/2012 | Nicoud | |
| 2013/0283615 A1 | | 10/2013 | Kaelin et al. | |

FOREIGN PATENT DOCUMENTS

| | | |
|---|---|---|
| EP | 2 420 899 A1 | 2/2012 |
| EP | 2 657 794 A1 | 10/2013 |

OTHER PUBLICATIONS

European Search Report issued Jun. 5, 2015 in European Application 14177987, filed on Jul. 22, 2014 ( with English Translation).

* cited by examiner

*Primary Examiner* — Vit W Miska

(74) *Attorney, Agent, or Firm* — Oblon, McClelland, Maier & Neustadt, L.L.P.

(57) ABSTRACT

A barrel includes a mainspring cooperating internally with a core, externally with a track of a drum by way of a resilient sliding bridle. The track and the bridle are of non-circular shape, nesting one inside the other in the free state of the bridle. The track and the bridle are arranged to make one raised portion of the bridle abuttingly engage with a sill of the track when the torque applied to the bridle is less than a torque limit value, and to allow radial constriction of the raised portion when the torque is greater than the limit value. The track and the bridle are arranged to allow the passage of the raised portion over the sill and to allow the bridle to travel angularly under the effect of the torque until the next encounter between the sill and the raised portion.

17 Claims, 2 Drawing Sheets

TIMEPIECE BARREL WITH IMPROVED TRANSMISSION OF FORCE

This application claims priority from European Patent Application No. 14177987.8 filed 22 Jul. 2014, the entire disclosure of which is incorporated herein by reference.

FIELD OF THE INVENTION

The invention concerns a timepiece barrel including at least one mainspring cooperating at the inner end thereof with a core pivoting about a pivot axis, and at the outer end thereof with an inner track of a barrel drum by means of a resilient sliding mainspring bridle, wherein said inner track and said resilient sliding bridle are each of non-circular shape, and nest one inside the other in the free state of said resilient sliding bridle, and are arranged such that at least one outwardly radially projecting raised portion comprised in said resilient sliding bridle is abuttingly engaged with at least one inwardly radially projecting sill comprised in said inner track when the torque applied to said resilient sliding bridle is less than a torque limit value, and wherein at least one said raised portion of said resilient sliding bridle is subjected to a radial constriction when the torque applied to said resilient sliding bridle is greater than said torque limit value, to allow said raised portion to pass over said sill and to allow said bridle to travel angularly under the effect of said torque until the next encounter between one said sill and one said raised portion.

The invention concerns a timepiece movement including one such barrel, whose core is arranged to cooperate with manual winding means.

The invention also concerns a timepiece including one such movement, and/or at least one mechanism including one such barrel.

The invention concerns the field of timepiece barrels for storing energy including a spring.

BACKGROUND OF THE INVENTION

The invention concerns the transmission of energy by a mainspring to a barrel drum via an element conventionally called a bridle. In general, for manually wound movements, the mainsprings are connected to the drum via a fixed bridle. For self-winding automatic movements, the transfer of force occurs via a sliding bridle or slip-spring which enables the end of the mainspring to be temporarily disengaged from the barrel above an disengagement limit torque.

The fixed bridle makes it possible to maximise the properties of the mainspring, particularly the number of turns, but has the drawback of generating overtorque when the mainspring reaches its maximum degree of wind: the user only feels that the spring is totally wound once the torque becomes significantly greater. This overtorque may cause not only problems of fatigue (breakage) but also chronometric problems.

The sliding bridle is indispensable for self-winding movements, however it is difficult for the user who manually winds the movement to know, without a power reserve indicator, when the barrel is fully wound. The presence of a sliding bridle or slip-spring generates a variation in torque when the barrel reaches the maximum degree of wind between the maximum moment of slippage (MGS) and the minimum moment of slippage (MGI). Further, this system does not allow proper control of the torque value above which disengagement occurs. Finally, these components, and particularly the barrel drum, are often subject to wear during aging tests.

U.S. Pat. No. 1,495,348A in the name of Daniel ODOM discloses a barrel with a drum whose inner periphery is corrugated in a regular manner, and wherein the sliding bridle of the mainspring can cooperate with the corrugation by resilient engagement of its distal end which includes a folded portion of the spring and a bent transverse rib, whose profile is locally substantially complementary to a groove of the corrugation.

U.S. Pat. No. 1,720,289A in the name of Daniel ODOM discloses a similar drum, cooperating with a spring that includes a large outwardly projecting folded portion, at around three quarters of the outer coil. This folded portion locally forms a substantially complementary profile to a groove of the corrugation. The outer three quarters of the outer coil press on the upper portions of the corrugation when there is no excessive torque as the barrel is wound.

EP Patent Application No 2420899 in the name of ETA Manufacture Horlogère Suisse discloses a mainspring including on the inner periphery thereof friction surfaces alternated with locking structures forming projecting corners. The distal end of the spring is friction-coupled to the inner wall against which it can slip. The friction surfaces are limited, downstream with respect to the direction of slippage of the outer coil, by a rounded edge or by a reflex edge.

SUMMARY OF THE INVENTION

The invention proposes a new system for the transmission of force between the bridle and the barrel drum. It consists of a specific barrel drum shape (non-cylindrical shape) and of a flexible bridle, whose shape is adapted to that of the mainspring. In fact, this bridle must be able to transmit the force from the mainspring to the drum, and, according to the invention, has the ability to deform so that, when a given torque is reached, the bridle can be uncoupled from the drum and thus slightly uncoil the mainspring without rotating the drum.

To this end, the invention concerns a timepiece barrel including at least one mainspring cooperating at the inner end thereof with a core pivoting about a pivot axis, and at the outer end thereof with an inner track of a barrel drum by means of a resilient sliding mainspring bridle, wherein said inner track and said resilient sliding bridle are each of non-circular shape, and nest one inside the other in the free state of said resilient sliding bridle, and are arranged such that at least one outwardly radially projecting raised portion comprised in said resilient sliding bridle is abuttingly engaged with at least one inwardly radially projecting sill comprised in said inner track when the torque applied to said resilient sliding bridle is less than a torque limit value, and wherein at least one said raised portion of said resilient sliding bridle is subjected to a radial constriction when the torque applied to said resilient sliding bridle is greater than said torque limit value, to allow said raised portion to pass over said sill and to allow said bridle to travel angularly under the effect of said torque until the next encounter between one said sill and one said raised portion.

The invention concerns a timepiece movement including one such barrel, whose core is arranged to cooperate with manual winding means.

The invention also concerns a timepiece including one such movement, and/or at least one mechanism including one such barrel.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
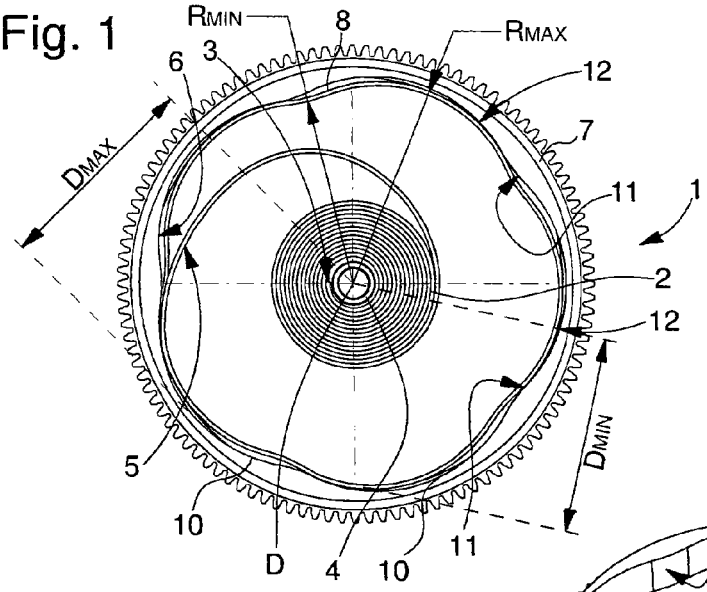
FIG. 1 shows a schematic plan view of a barrel according to the invention, with a mainspring carrying a shaped bridle carrying a plurality of raised portions, mounted in a barrel drum including a succession of housings separated by sills; in this configuration, the mainspring is fully wound.

The invention concerns a timepiece barrel 1 including at least one mainspring 2 cooperating:

at the inner end 3 thereof with a core 4 pivoting about a pivot axis D, at the outer end 5 thereof with an inner track 6 of a barrel drum 7 by means of a resilient sliding bridle 8.

According to the invention, inner track 6 and resilient sliding bridle 8 are each of non-circular shape and nest one inside the other in the free state of resilient sliding bridle 8.

Resilient sliding bridle 8 includes at least one outwardly radially projecting raised portion 12.

Inner track 6 includes at least one inwardly radially projecting sill 11, towards pivot axis D.

Inner track 6 and resilient sliding bridle 8 are arranged so that at least one such raised portion 12 is abuttingly engaged with at least one such sill 11, when the torque applied to resilient sliding bridle 8 is less than a torque limit value.

At least one such raised portion 12 is subjected to a radial constriction, due to the resilience of resilient sliding bridle 8, when the torque applied to resilient sliding bridle 8 is greater than the torque limit value, to allow raised portion 12 to pass over sill 11, and to allow bridle 8 to travel angularly under the effect of the torque until the next encounter between a sill 11 and a raised portion 12.

In a preferred variant, the resilient sliding bridle 8 forms a closed contour.

During the winding operation, mainspring 2 is gradually wound around core 4 until it reaches the maximum degree of wind, and the cooperation between a raised portion 12 of resilient sliding bridle 8 with a sill 11 of inner track 6 of said barrel drum 7 causes resilient sliding bridle 8 to deform under the action of the torque applied, to produce a disengagement, as a result of which resilient sliding bridle 8 and spring 2 move forward one notch.

The relative shapes of inner track 6 of barrel drum 7 and of raised portion 12 of resilient sliding bridle 8 are arranged so that the disengagement corresponds to a predetermined maximum torque.

Preferably, disengagement is obtained only by resilient deformation of a portion of resilient sliding bridle 8 greater than 50% of its periphery.

FIG. 1 shows mainspring 2 fully wound, which means that if the mainspring continues to be wound (manually or automatically), the shaped bridle 8 will deform and detach itself from barrel drum 7.

A mainspring 2 of standard shape can either be connected to an independent shaped bridle 8 by a bonding, brazing or soldering method, or preferably form with said shaped bridle 8 a one-piece part, preferably made of the same material.

When the barrel is completely uncoiled, the coils are wound directly onto shaped bridle 8.

During winding, mainspring 2 is gradually wound around core 4 until the maximum degree of wind is reached. The specific shape of the drum then causes shaped bridle 8 to deform so that disengagement occurs. The relative shapes of drum 7 and of shaped bridle 8 are optimised so that the disengagement torque corresponds to the desired maximum torque, which is determined as a function of the properties of the mainspring and of the friction coefficient.

When disengagement occurs, i.e. when the shaped bridle and the mainspring have moved forward one notch, the torque available from the barrel drum is lower (MGI minimum moment of slippage).

Figure 2:
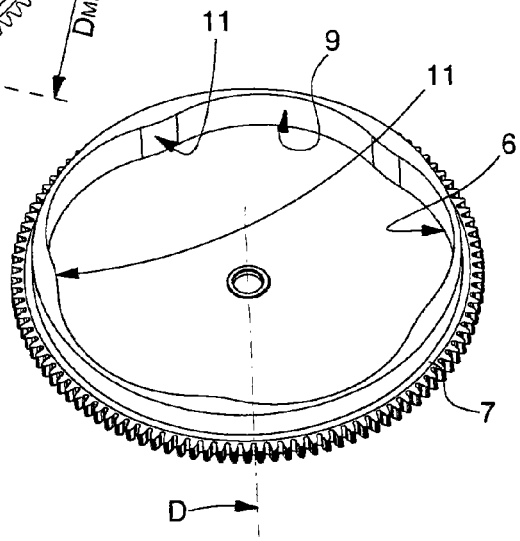
FIG. 2 shows a schematic, perspective view of the drum of FIG. 1.
Figure 3:
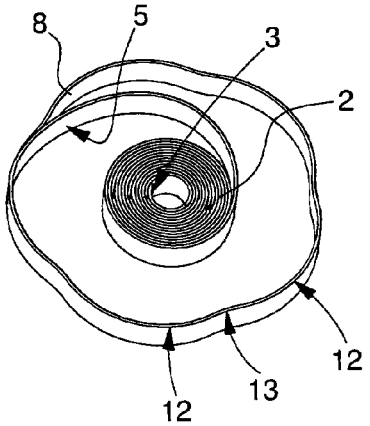
FIG. 3 shows a schematic, perspective view of the mainspring of FIG. 1, equipped with the shaped bridle which includes raised portions alternated with recessed joining surfaces.
Figure 4:
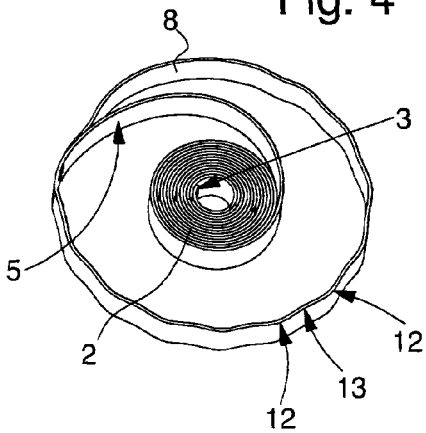
FIG. 4 shows a schematic, perspective view of a mainspring according to a variant of FIG. 3 with more raised portions, also suited to the drum of FIG. 2.

In a particular embodiment, as seen in FIGS. 1 and 2, the inner track 6 includes a plurality of peripheral housings 9 each including a base 10 located at the greatest distance DMAX from pivot axis D. These housings 9 are each separated from the next housing by a sill 11 located at the smallest distance DMIN from pivot axis D.

Sliding bridle 8 is advantageously and preferably integral with mainspring 2 with which it then forms a one-piece assembly.

This sliding bridle 8 includes, in the non-limiting embodiments of FIGS. 1 to 5, a plurality of such raised portions 12, each of which, in the free state, has a maximum radius RMAX with respect to pivot axis D. These raised portions 12 are each separated from the next raised portion by a joining surface 13 including an area of minimum radius RMIN with respect to pivot axis D, the maximum radius RMAX in the free state being greater than minimum distance DMIN and less than maximum distance DMAX.

Figure 5:
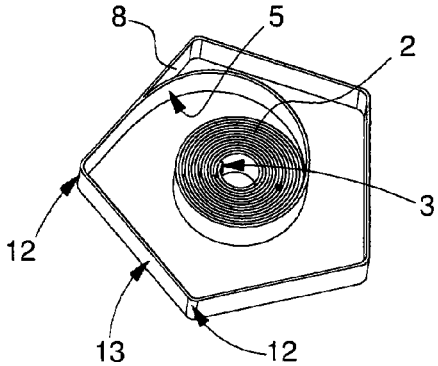
FIG. 5 shows a schematic, perspective view of a mainspring according to a variant of FIG. 3 with raised portions alternated with flat joining surfaces, also suited to the drum of FIG. 2.

Joining surfaces 13 may be skew, concave or convex, or even planar as in FIG. 5.

The radial constriction of raised portions 12, due to the resilience of sliding bridle 8, and under the action of the applied torque, allows the reduction of swing radius with respect to pivot axis D to a value of less than or equal to minimum distance DMIN, enabling said raised portions to pass over a sill 11.

Figure 6:
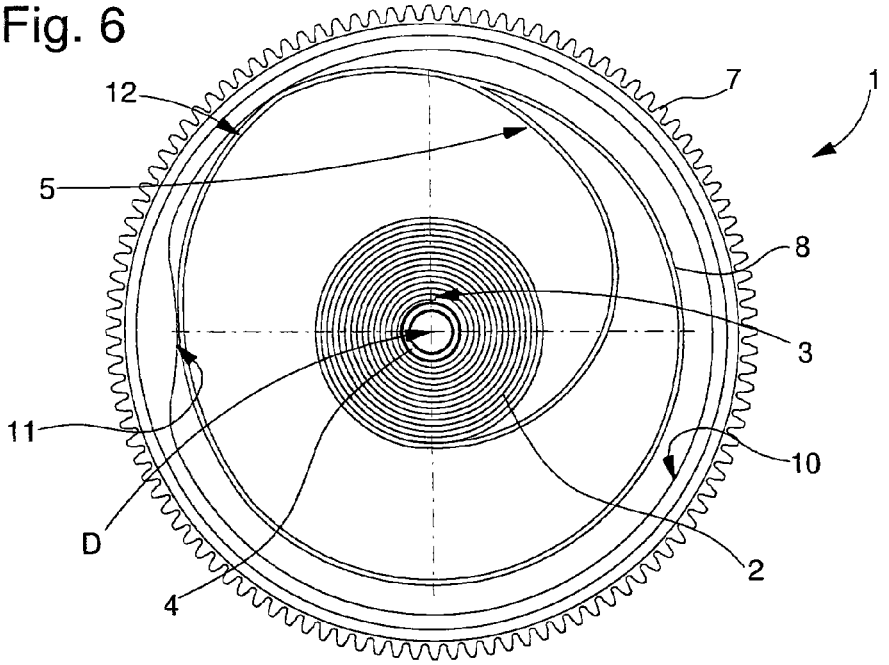
FIG. 6 shows, in a similar manner to FIG. 1, a barrel according to the invention, with a bridle having only one raised portion and a barrel drum including only one housing.
Figure 7:
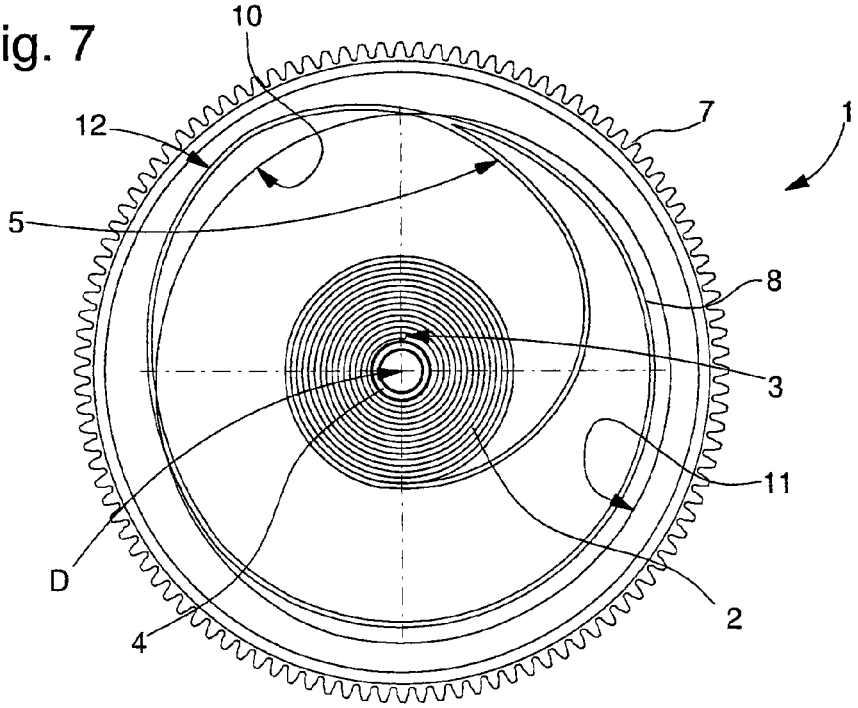
FIG. 7 shows the reverse configuration of FIG. 6.
Figure 8:
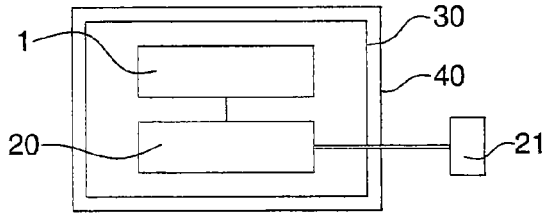
FIG. 8 shows block diagrams of a timepiece including a movement in turn including a barrel of this type operated by a manual winding mechanism actuated by a crown.

The invention may also be used with a barrel whose inner track 6 has only one housing 9, as seen in FIG. 6. FIG. 7 also illustrates a configuration with a single housing 9, but operating in the reverse manner; sliding bridle 8 is always in friction-contact with a wall of inner track 6 except when its raised portion 12 cooperates with housing 9: the user who manually winds his watch experiences a similar sensation, although in reverse, and he feels the change of notch just as distinctly. These two FIGS. 6 and 7 also illustrate a bridle 8 with a single raised portion 12.

It is also possible to use a barrel with several housings 9, as seen in FIG. 2, with one sliding bridle 8 which includes a single raised portion.

In the maximum winding position of mainspring 2, each passage of a raised portion 12 over a sill 11 returns the available torque in drum 7 from a higher slippage value MGS to a lower slippage value MGI, which is lower than higher slippage value MGS.

In certain variants, as in FIGS. 1 and 2, inner track 6 includes a plurality of peripheral housings 9 of cycloidal shape. FIG. 2 shows a bridle 8 with five cycloids, but in another version, it is possible to envisage having more or fewer depending on the desired sizing, for example there are ten in FIG. 4.

In certain variants, as in FIGS. 1 and 2, inner track 6 and resilient sliding bridle 8 are of identical shape and homothetic dimensions.

In certain variants, inner track 6 and resilient sliding bridle 8 are of different shapes, depending on the desired sizing. It is possible, for example, to combine mainsprings 2 of FIGS. 4 and 5 with drum 7 of FIG. 2.

In certain variants, inner track 6 includes a first number of sills 11, resilient sliding bridle 8 includes a second number of raised portions 12 and the second number is higher than or equal to the first number. In other variants, inner track 6 includes a first number of sills 11, resilient sliding bridle 8 includes a second number of raised portions 12 and the second number is lower than the first number.

In a particular variant, mainspring 2 is fixed at several points to resilient sliding bridle 8.

The invention is applicable to any type of barrel: a barrel for driving the movement, a striking barrel or other barrel.

The invention also concerns a timepiece movement 30 including one such barrel 1, whose core 4 is arranged to cooperate with manual winding means 20, for example via a ratchet or similar.

The invention concerns a timepiece 40 including one such movement 30 and/or at least one mechanism including one such barrel 1, such as a striking mechanism, or an alarm mechanism or suchlike. Preferably, this timepiece is a watch.

The invention provides numerous advantages:

the system permits direct control of the disengagement torque disengaging mainspring 2 from the drum (MGS) via the dimensions of shaped bridle 8;

the system can be integrated in a manual winding mechanism 20, controlled by a crown 21 or a bolt, or suchlike, and thereby limit the overtorque generally present at the maximum degree of wind when a fixed bridle is used. This makes it possible to limit the increase of stress, which is a cause of breakage, either directly or through fatigue, and also avoids the chronometric problems caused by overtorque (notably knocking);

this type of geometry makes it possible for the user to feel the notch during winding operations when the maximum degree of wind is reached;

the invention makes it possible to perform the disengagement function by means of overall deformation of a resilient component: with the same disengagement torque, the stress in the bridle is less than than of a conventional barrel;

the mainspring can also be fixed at several points of the bridle in order to better distribute stress in the connection between the mainspring and the bridle;

the invention can be used for all timepiece movements or mechanisms and similar devices, notably musical boxes, which use a mainspring as an energy source, and in particular for manually wound movements, in place of a fixed bridle.

What is claimed is:

1. A timepiece barrel comprising:

at least one mainspring cooperating at an inner end thereof with a core pivoting about a pivot axis, and at an outer end thereof with an inner track of a barrel drum by way of a resilient sliding bridle, wherein said inner track and said resilient sliding bridle are each of non-circular shape, and said resilient sliding bridle is nested inside said inner track in a free state of said resilient sliding bridle, and said inner track and said resilient sliding bridle are arranged such that a plurality of outwardly radially projecting raised portions comprised in said resilient sliding bridle are abuttingly engaged with a plurality of corresponding inwardly radially projecting sills comprised in said inner track when torque applied to said resilient sliding bridle is less than a torque limit value, wherein said resilient sliding bridle forms a closed contour, and wherein said raised portions of said resilient sliding bridle are subjected to a radial constriction when the torque applied to said resilient sliding bridle is greater than said torque limit value, to allow each of said raised portions to pass over each corresponding one of said sills and to allow said bridle to travel angularly under an effect of said torque until a next encounter between said sills and said raised portions.

2. The barrel according to claim 1, wherein said inner track includes a plurality of peripheral housings each including a base located at the greatest distance from said pivot axis and said housings are each separated from the next housing by said sill located at the smallest distance from said pivot axis, and wherein said sliding bridle is integral with said mainspring and forms a one-piece assembly therewith, and includes a plurality of said raised portions, each of which, in the free state, has a maximum radius with respect to said pivot axis and each of which is separated from the next raised portion by a joining surface including an area of minimum radius with respect to said pivot axis, said maximum radius in the free state being greater than said smallest distance and less than said greatest distance.

3. The barrel according to claim 2, wherein said radial constriction of said raised portions permits reduction of the radius thereof with respect to said pivot axis to a value lower than or equal to said smallest distance in order to pass over said sill.

4. The barrel according to claim 1, wherein, in a maximum winding position of said mainspring, each passage of said raised portions over said sills returns an available torque in said drum from a higher slippage value to a lower moment of slippage value which is lower than said higher slippage value.

5. The barrel according to claim 1, wherein said inner track includes a plurality of peripheral housings of cycloidal shape.

6. The barrel according to claim 1, wherein said inner track and said resilient sliding bridle are of identical shape and of homothetic dimensions.

7. The barrel according to claim 1, wherein said inner track and said resilient sliding bridle are of different shapes.

8. The barrel according to claim 1, wherein said mainspring is fixed at several points of said resilient sliding bridle.

9. The barrel according to claim 1, wherein said inner track includes a first number of said sills, wherein said resilient sliding bridle includes a second number of said raised portions, and wherein said second number is greater than or equal to said first number.

10. The barrel according to claim 1, wherein said inner track includes a first number of said sills, wherein said resilient sliding bridle includes a second number of said raised portions, and wherein said second number is lower than or equal to said first number.

11. The barrel according to claim 1, wherein during a winding operation, said mainspring is gradually wound around said core until a maximum degree of wind is reached and wherein cooperation between said raised portions of said resilient sliding bridle with said sills of said inner track of said barrel drum causes said resilient sliding bridle to deform under an action of the applied torque to perform disengagement as a result of which said resilient sliding bridle and said spring move forward one notch.

12. The barrel according to claim 11, wherein relative shapes of said inner track of said barrel drum and of said raised portions of said resilient sliding bridle are arranged so that said disengagement corresponds to a predetermined maximum torque.

13. The barrel according to claim 11, wherein said disengagement is obtained exclusively by a resilient deformation of one portion of said resilient sliding bridle greater than 50% of the periphery thereof.

14. A timepiece movement including the barrel according to claim 1, wherein said core is arranged to cooperate with manual winding means.

15. A timepiece including at least one mechanism including said barrel according to claim 1.

16. The barrel according to claim 1, wherein an outer periphery of said closed contour is dimensionally similar to said inner track.

17. A timepiece barrel comprising:

at least one mainspring cooperating at an inner end thereof with a core pivoting about a pivot axis, and at an outer end thereof with an inner track of a barrel drum by way of a resilient sliding bridle, wherein said inner track and said resilient sliding bridle are each of non-circular shape, and said resilient sliding bridle is nested inside said inner track in a free state of said resilient sliding bridle, and said inner track and said resilient sliding bridle are arranged such that at least one outwardly radially projecting raised portion comprised in said resilient sliding bridle is abuttingly engaged with at least one inwardly radially projecting sill comprised in said inner track when torque applied to said resilient sliding bridle is less than a torque limit value, wherein said resilient sliding bridle includes a plurality of said raised portions and forms a closed contour an outer periphery of which is dimensionally similar to said inner track, and wherein said at least one raised portion of said resilient sliding bridle is subjected to a radial constriction when the torque applied to said resilient sliding bridle is greater than said torque limit value, to allow said raised portion to pass over said sill and to allow said bridle to travel angularly under an effect of said torque until a next encounter between said sill and another of said raised portions.

* * * * *